US006193427B1

(12) United States Patent
Benguigui

(10) Patent No.: US 6,193,427 B1
(45) Date of Patent: Feb. 27, 2001

(54) DEVICE FOR DISTRIBUTING A PASTY, IN PARTICULAR, COSMETIC, PRODUCT AND METHOD OF MANUFACTURING THIS DEVICE

(76) Inventor: Daniel Benguigui, Quartier Pallassas, 84480 Lacoste (FR)

( * ) Notice: Subject to any disclaimer, the term of this patent is extended or adjusted under 35 U.S.C. 154(b) by 0 days.

(21) Appl. No.: 09/318,865

(22) Filed: May 26, 1999

(30) Foreign Application Priority Data

May 26, 1998 (FR) ..... 98 06620

(51) Int. Cl.[7] ..... A45D 40/20
(52) U.S. Cl. ..... 401/88; 401/98; 706/823
(58) Field of Search ..... 401/88, 98, 49; 206/385, 438, 486, 823; 220/252, 264, 337, 339, 341

(56) References Cited

U.S. PATENT DOCUMENTS

| | | | | |
|---|---|---|---|---|
| 4,208,143 | * | 6/1980 | Nored | 401/98 |
| 4,459,058 | * | 7/1984 | Bennett | 401/88 |
| 5,046,875 | * | 9/1991 | Skolnik | 401/98 |
| 5,092,700 | * | 3/1992 | Susini et al. | 401/98 |
| 5,306,107 | * | 4/1994 | Kageyama et al. | 401/98 |

* cited by examiner

*Primary Examiner*—David J. Walczak
(74) *Attorney, Agent, or Firm*—Leydig, Voit & Mayer, Ltd.

(57) ABSTRACT

A device for dispensing a pasty product in a body enclosed in a casing having a stationary hollow body and a cap for closing and opening the casing to permit the use of the pasty product, wherein the bottom portion of the body of the pasty product is anchored in the hollow body and the cap encloses a free usable portion of the body of the pasty product. The invention is usable for dispensing a cosmetic product such as lipstick.

7 Claims, 1 Drawing Sheet

DEVICE FOR DISTRIBUTING A PASTY, IN PARTICULAR, COSMETIC, PRODUCT AND METHOD OF MANUFACTURING THIS DEVICE

FIELD OF THE INVENTION

The invention relates to a device for distributing a pasty, in particular cosmetic product such as a lipstick consisting of a body enclosed in a casing having been used as a mould for the making of the porduct, the casing comprising a stationary hollow body and a cap for closing and opening the casing to permit the use of the pasty product and to a method of manufacture of such a distributing or dispensing device.

BACKGROUND OF THE INVENTION

In the dispensing devices of this type which are known, the paste consists of a stick carried by a piston axially movable in the casing between a retracted position and an outward extended position of use. In such a case, the casing is essentially constituted by an elongated tubular body and a cap is made as a cover for closing the top end of the body.

These known distributing or dispensing devices are designed in order that the stick may have the greatest possible length and that the height of the base inserted into the piston be relatively small with respect to this length. Research has shown that the structure of the dispensing device is complex and that the filling with a pasty product from the base or bottom of the device is difficult to carry out automatically. Now to the extent where the devices for dispensing cosmetic products are products manufactured in a great number, these two facts constitute serious inconveniences.

SUMMARY OF THE INVENTION

The object of the present invention is to provide a distributing or dispensing device of the kind described hereinabove, which would not exhibit these inconveniences.

To reach this goal, the distributing or dispensing device according to the invention has a hollow body for anchoring the base portion of the body of the pasty product surrounding the latter and the cap surrounds the free usable portion of this body.

According to of the invention, the cap is pivotally connected to the hollow body through a pivot means mounted between opposite front faces of the body and of the cap. Pivoting between positions of closing and of opening the casing.

According to invention, at least that side face of the body of the pasty product which is opposite to the pivot means exhibits, in the plane of pivoting, a profile in the shape of an arc of a circle having radius slightly smaller than the distance between the pivot axis and the lower peripheral edge line of the front face of the cap at the level of this side face.

According to the invention, the hollow body comprises, in its base face, a sealable aperture to be used as a hole for filling the casing with the pasty product.

According to the invention, the aperture is sealable with a stopper after the filling.

According to the invention, the opposite front faces of the hollow body and of the cap comprise sealing means advantageously provided by a peripheral rib provided on one of the two opposite faces and intended to be inserted in a groove of complementary shape the other face.

According to the invention, the casing exhibits a general ovoidal shape advantageously with an oval cross section in a plane parallel to the pivot axis, the latter extending in parallel relation to the minor or short axis of this cross section.

A method of manufacture of the device for distributing or dispensing a pasty product according to the invention includes making in a single operation, the casing as one single piece through injection, filling the casing in the closed state with the pasty product through the filling aperture provided in the base face of the casing and thereafter sealing this filling aperture by the insertion of a closure stopper into the aperture.

BRIEF DESCRIPTION OF THE DRAWING FIGURES

The invention will be better understood and further objects, characterizing features, details and advantages thereof will appear more clearly as the following explanatory description proceeds, made with reference to the attached diagrammatic drawings given by way of non limiting examples only illustrating one presently preferred specific embodiment of the invention and in which.

DETAILED DESCRIPTION OF THE PREFERRED EMBODIMENTS

Figure 2:
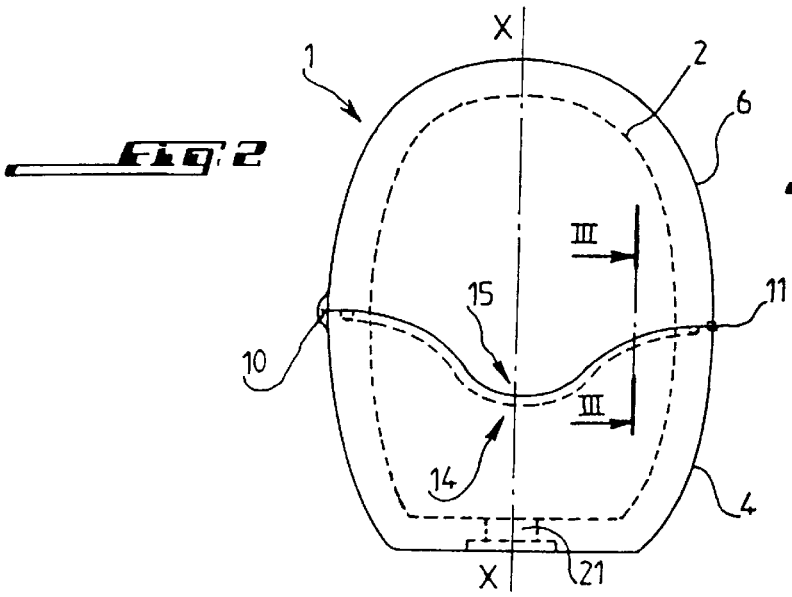
FIG. 2 is an elevational view of the distributing device according to FIG. 1.
Figure 3:
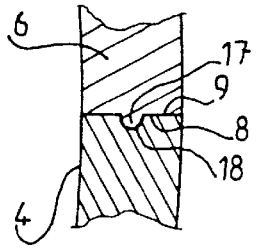
FIG. 3 is a view in section taken upon the line III—III of FIG. 2.
Figure 1:
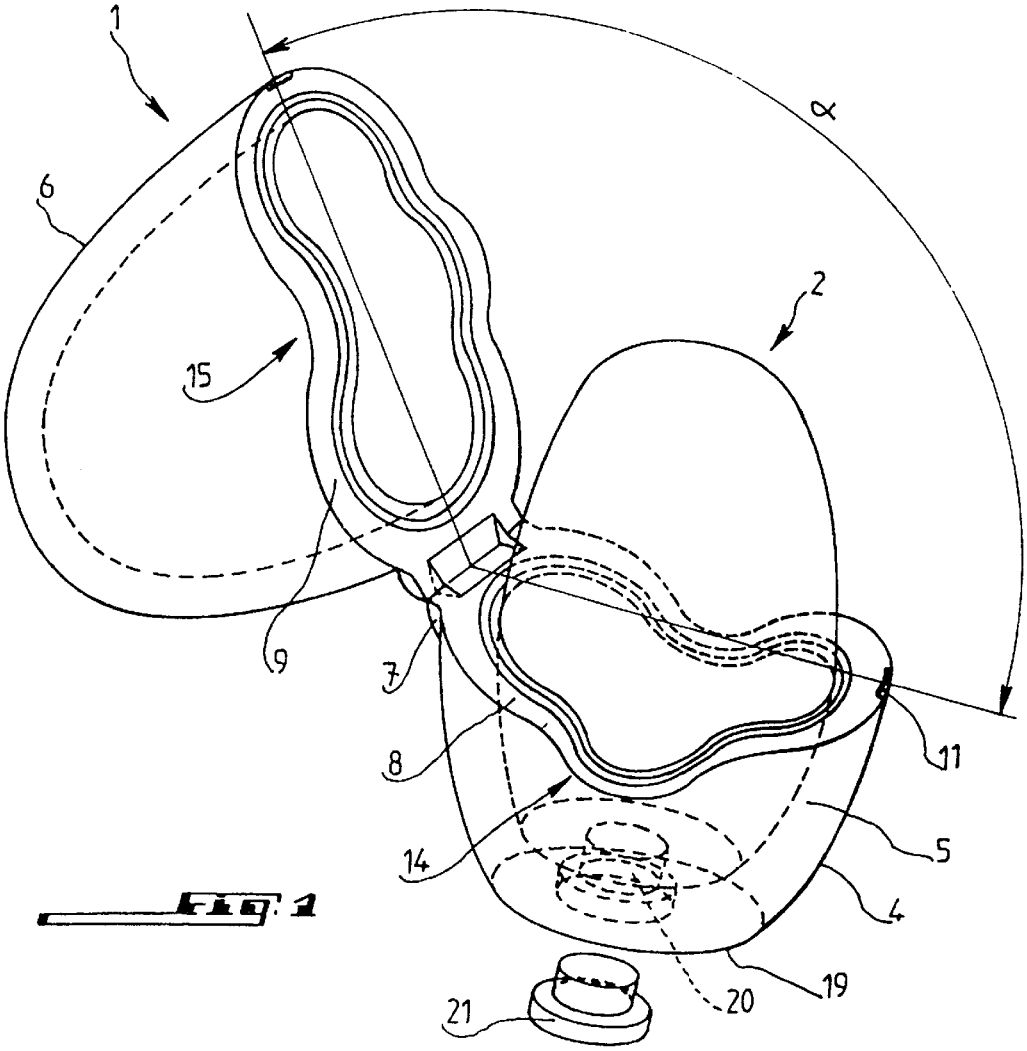
FIG. 1 is a perspective view of a device for dispensing a pasty product according to the present invention, showing the cap during its pivoting movement between the positions of opening and of closing the casing.

As clearly shown in FIGS. 1 and 2, the device for dispensing a pasty, in particular, cosmetic, product, such as a lipstick, comprises a casing 1 with a general ovoidal shape, as shown in FIG. 2, exhibiting, in a plane perpendicular to the longitudinal axis X—X shown in FIG. 2, substantially oval cross sections and a body of pasty product 2 enclosed within the casing 1 and exhibiting the shape corresponding to the internal face of the casing. The casing is made from a plastic material such as polypropylene or polyethylene and comprises a stationary hollow body 4 within which the base 5 of the block 2 of pasty product is anchored and a cap 6 pivotally connected to the base body 4 through pivot means 7 mounted between the opposite front faces 8 and 9 of the body 4 and of the cap 6, respectively. The cap may therefore swing about an axis 10 located substantially at the level of the outer peripheral surface of the casing, between a closed position and an open position in which the body and the cap are juxtaposed. In the opposite portion of the pivot means 7, the hollow body 4 and the cap 6 comprise gripping means 11 facilitating the opening of the casing.

The front face 8 of the hollow body 4 exhibits in the middle between the pivot means 7 and the gripping or opening means 11, hollow zones 14 having a rounded shape, into which projecting zones 15, of complementary shape, of the cap 6 are inserted. The casing moreover comprises sealing means to prevent the pasty product from flowing outwards when the casing is closed. These sealing means essentially comprise a peripheral rib 17 on the front face 9 of the cap, which extends all about the body 2 and a groove 18 of complementary shape, in the front face 8 of the stationary hollow body 4.

The base 19 of the body 4 is flattened and has a through hole 20 permitting the filling of the casing with a pasty product. This filling hole 20 is sealable with a stopper 21 which will be permanently put in place in the hole 20 after the filling step.

As to the pivot means 7, it is of the type known per se with a sudden or snap-like automatic pivatal movement after having moved past a predetermined angle of pivoting $\alpha$ of 135°, for example. Pivot means 17 ensure that the cap remains in its maximum opening position with an angle of 180° until the application of a suitable force acting in the closing direction of the cap.

Of course, as illustrated in FIG. 1, the cap 6 is arranged so that upon opening by pivoting, its inside surface does not rub against the block 2 of the pasty product. To ensure there is no undue rubbing, the block 2 of the pasty product has, in a plane perpendicular to the pivot axis 10 and intersecting the surface of the block 2 of the pasty product most distance from the pivot axis 10, an arcuate profile with a radius smaller than the distance between the pivot axis 10 and the inside surface to the cap 6, in that plane, where the cap touches the body 4 when the cap 6 is closed.

It should further be pointed out that one may provide inside of the casing and in particular of the cap, an insert (not shown) covering the internal face thereof and made from a material compatible with the pasty product.

Owing to this simple structure of the dispensing device which has just been described, the manufacture of the latter may be easily carried out automatically. In effect, in a first operating step, one makes the casing through injection in one single piece integral with the base body 4 and the cap 6 in the open state, the pivot means 7 being then also made integral in one single piece of material. One then closes the casing and fills the latter with pasty product by inserting the latter through the filling hole 20. One then puts in place the stopper 21. One easily understands that the manufacture as well as the filling constitute operating steps which may carried out automatically without any difficulty.

Thus, the present invention provides a dispensing device of simple and not very expensive structure and manufacture, based upon the consideration that the inconvenience of some loss of pasty product due to the anchoring of the body 2 within the lower half of the casing formed of the hollow body 4 does not constitute a real inconvenience but, on the contrary, is advantageous because one thus obtains the advantage of a very simple and automatable manufacture of the casing. In effect the plastic casing and its assembly normally constitute the expensive part whereas the pasty product is of a lower price.

What is claimed is:

1. A device for dispensing a pasty product comprising:

a body of a pasty product;

a casing comprising a hollow body and a cap for closing and opening the casing for access to the body of the pasty product, wherein the body of the pasty product has a first part anchored within the hollow body and a second part enclosed by the cap when the casing is closed; and pivot means pivotably connecting the cap to the hollow body and mounted between opposite faces of the hollow body and the cap for pivoting of the cap, relative to the hollow body, between open and closed positions, the pivot means automatically pivoting the cap to the open position and the closed position after the cap pivots beyond a threshold angle relative to the hollow body toward the open position and the closed position, respectively.

2. The device for dispensing according to claim 1, wherein the hollow body comprises a bottom face with a sealable aperture for filling the casing with the pasty product.

3. The device for dispensing according to claim 2, including a stopper for sealing the aperture.

4. A method of manufacturing the device for dispensing a pasty product according to claim 3, comprising making the casing as one single piece by injection, filling the casing, while the cap is in the closed position, with the body of the pasty product through the sealable aperture, and sealing the sealable aperture with the stopper.

5. The device for dispensing according to claim 1, wherein the faces of the hollow body and of the cap contacting each other when the cap is in the closed position comprise sealing means including a peripheral rib on one of the faces and a groove complementary to the rib in the other face for receiving the rib.

6. The device for dispensing according to claim 1, wherein the pivot means has a pivot axis and the body of the pasty product has a peripheral face opposite the pivot means which has, in a plane perpendicular to the pivot axis of the pivot means, an arcuate profile with a radius smaller than a distance in the plane between the pivot axis and a peripheral edge at an inside surface of the face of the cap contacting the face of the hollow body when the cap is in the closed position.

7. The device for dispensing according to claim 1, wherein the pivot means has a pivot axis and the casing, when the cap is in the closed position, has a generally ovoidal cross-section in a first plane perpendicular to the pivot axis, and an oval cross-section in a second plane containing the pivot axis and perpendicular to the first plane.

* * * * *